US010098398B2

(12) United States Patent
Lacy et al.

(10) Patent No.: US 10,098,398 B2
(45) Date of Patent: Oct. 16, 2018

(54) REVERSE SPLIT BRIM

(71) Applicant: SUNDAY AFTERNOONS, INC., Talent, OR (US)

(72) Inventors: Robbin Lacy, Talent, OR (US); Russell Hodgdon, Talent, OR (US); Gulnara Iskhakova, Talent, OR (US)

(73) Assignee: Sunday Afternoons, Inc., Talent, OR (US)

( * ) Notice: Subject to any disclaimer, the term of this patent is extended or adjusted under 35 U.S.C. 154(b) by 227 days.

(21) Appl. No.: 14/809,039

(22) Filed: Jul. 24, 2015

(65) Prior Publication Data

US 2016/0021960 A1 Jan. 28, 2016

Related U.S. Application Data

(60) Provisional application No. 62/028,772, filed on Jul. 24, 2014.

(51) Int. Cl.

| | |
|---|---|
| ***A42B 1/22*** | (2006.01) |
| ***A42B 1/24*** | (2006.01) |
| ***A42B 1/06*** | (2006.01) |
| ***A42B 1/20*** | (2006.01) |

(52) U.S. Cl.

CPC ..... *A42B 1/201* (2013.01); *A42B 1/063* (2013.01); *A42B 1/22* (2013.01); *A42B 1/247* (2013.01)

(58) Field of Classification Search

CPC ..... A42B 1/201; A42B 1/063; A42B 1/002; A42B 1/20; A42B 1/205; A42B 1/06; A42B 1/061; A42B 1/062

USPC ..... 2/171.03, 171.6, 175.5, 195.5, 195.6

See application file for complete search history.

(56) References Cited

U.S. PATENT DOCUMENTS

| | | | | |
|---|---|---|---|---|
| 742,731 A | | 10/1903 | Plato | |
| 3,357,026 A | * | 12/1967 | Wiegandt | A42B 1/063 2/195.6 |
| 5,802,616 A | * | 9/1998 | Watson | A42B 1/02 2/175.1 |
| 6,163,888 A | * | 12/2000 | Park | A42B 1/22 2/183 |
| 6,357,051 B1 | * | 3/2002 | Lee | A42B 1/201 2/195.1 |
| 9,089,181 B1 | * | 7/2015 | Sigle | A42B 1/241 |
| 2006/0162047 A1 | * | 7/2006 | Yan | A42B 1/201 2/195.6 |

* cited by examiner

*Primary Examiner* — Jameson Collier
*Assistant Examiner* — Heather Mangine
(74) *Attorney, Agent, or Firm* — McCoy Russell LLP

(57) ABSTRACT

Embodiments are disclosed for headwear including a folding brim. For example, the headwear may include a headwear body including a crown, and a hat brim extending from the crown, the hat brim including one or more slits forming a hinge on an underside of the hat brim for folding the hat brim, each slit being reinforced with bias material along each edge of the slit and a center webbing over an opening formable under the slit when the brim is in a folded position, the bias material being coupled to an inner surface of each edge of the slit.

18 Claims, 6 Drawing Sheets

REVERSE SPLIT BRIM

CROSS-REFERENCE TO RELATED APPLICATIONS

The present application claims priority to U.S. Provisional Patent Application No. 62/028,772 entitled "FORAGE HAT," filed Jul. 24, 2014, the entire contents of which are hereby incorporated by reference for all purposes.

FIELD

The disclosure relates to a hat including a reverse split folding brim.

BACKGROUND

Headwear may be utilized to shield a wearer from environmental hazards, such as sunlight, debris, rain, etc. Wide-brimmed hats may provide more protection from such hazards, but may be bulkier than other styles of hats, such as caps with visors. However, in general, any type of hat may benefit from being folded for compact storage.

Hat brims may include rigid or semi-rigid material to maintain or bias a particular brim shape. In order to promote folding of hats including such hat brims, some hats, such as those described in U.S. Pat. No. 6,357,051 (Lee) and U.S. Pat. No. 742,731 (Plato) include splits in a top of a brim to allow the brim of the hat to fold downward (e.g., in a direction toward a wearer's face). However, the inventors have recognized that such configurations often result in a deformation of the hat brim when worn in the standard (e.g., unfolded) condition. For example, the hat brim may tend to peak around the split, creating an "A-Frame" appearance, rather than an intended smooth curve or flat brim appearance. Further, in such hats, a crown typically extends above the brim. By folding the brim downward and away from the crown, the crown is forced further upward, limiting the amount of compactness afforded to the hat via the folding operation.

SUMMARY

Embodiments are disclosed for headwear including various technological features for providing durability and flexibility in multiple environments and usage scenarios. For example, headwear according to the following disclosure may include a headwear body including a crown, and a hat brim extending from the crown, the hat brim including one or more slits forming a hinge on an underside of the hat brim for folding the hat brim, each slit being reinforced with bias material along each edge of the slit and a center webbing over an opening formable under the slit when the brim is in a folded position, the bias material being coupled to an inner surface of each edge of the slit. The inventors have recognized that including a slit on an underside of the hat brim enables the hat to be folded upward, allowing for the natural collection of the crown into a pocket formed between distal edges of the brim. Furthermore, by providing the bias material along the edge of the slits and center webbing over the opening under the slit, a deformity of the brim may be reduced while the brim is unfolded, effectively removing the "A-Frame" phenomenon described above.

BRIEF DESCRIPTION OF THE DRAWINGS

The disclosure may be better understood from reading the following description of non-limiting embodiments, with reference to the attached drawings, wherein below.

DETAILED DESCRIPTION

As described above, existing foldable hats often rely upon a split in the top of the brim to effect a downward folding of the brim. The inventors recognized several drawbacks with this folding solution, including a deformation of the brim in an unfolded state, as the brim is urged toward the folded state due to forces of gravity and other forces. Additionally, the downward folding causes the brim to be folded away from additional features of the hat, such as a crown that extends above the brim, thereby limiting the amount of compactness achieved by the folding. In contrast, the foldable brim described in this disclosure includes one or more slits on a bottom/inner region of the brim to allow the brim to be folded upward. In this way, the motion of folding may naturally collect the crown into the folded brim, even without the user tucking the crown into or around the brim. The effective space occupied by the folded hat of the present disclosure may thus be reduced from the prior folding hats in an initial folding operation. The upward folding also reduces the hat's susceptibility to gravitational forces urging the hat into its folded state, as the folded state is achieved by a force opposing gravity while the hat is being worn. Furthermore, the disclosure provides for reinforcing material in various regions of the slit in order to further resist forces (e.g., of gravity) urging the hat into its folded state and reduce deformation in the shape of the brim. The reinforcements may also ensure that interior components of the brim (e.g., brim wires) are protected from exiting the brim during folding.

The example headwear provided in this disclosure may include a brimmed hat (e.g., a wide-brimmed hat, such as a sun hat) that includes a folding split brim, as well as a flexible application of trims and fabrics. For example, the headwear may be configured with a material composition that is effective for providing camouflage, blocking UV rays, transferring heat away from the head, resisting and/or repelling water, etc. Structural supports may be embedded in various regions of the headwear (e.g., within the brim) to provide additional support of a biased shape of the headwear and/or promote flexibility of the headwear. These and other features (described in more detail below) may be provided in various combinations of headwear embodiments to provide a robust, flexible, and functional hat that performs well in any environment and stands up to heavy use. Although illustrated and described as a wide-brimmed hat, it is to be understood that any one or more of the features described herein may be included in any suitable style of hat, including, without limitation, a charter hat, a sun fedora, a boonie hat, a capotain, a gat, a hardee hat, a homburg, a panama, a sombrero, a sun visor, a top hat, a legionnaire hat, a flap hat, and/or any other suitable head covering.

Figure 1:
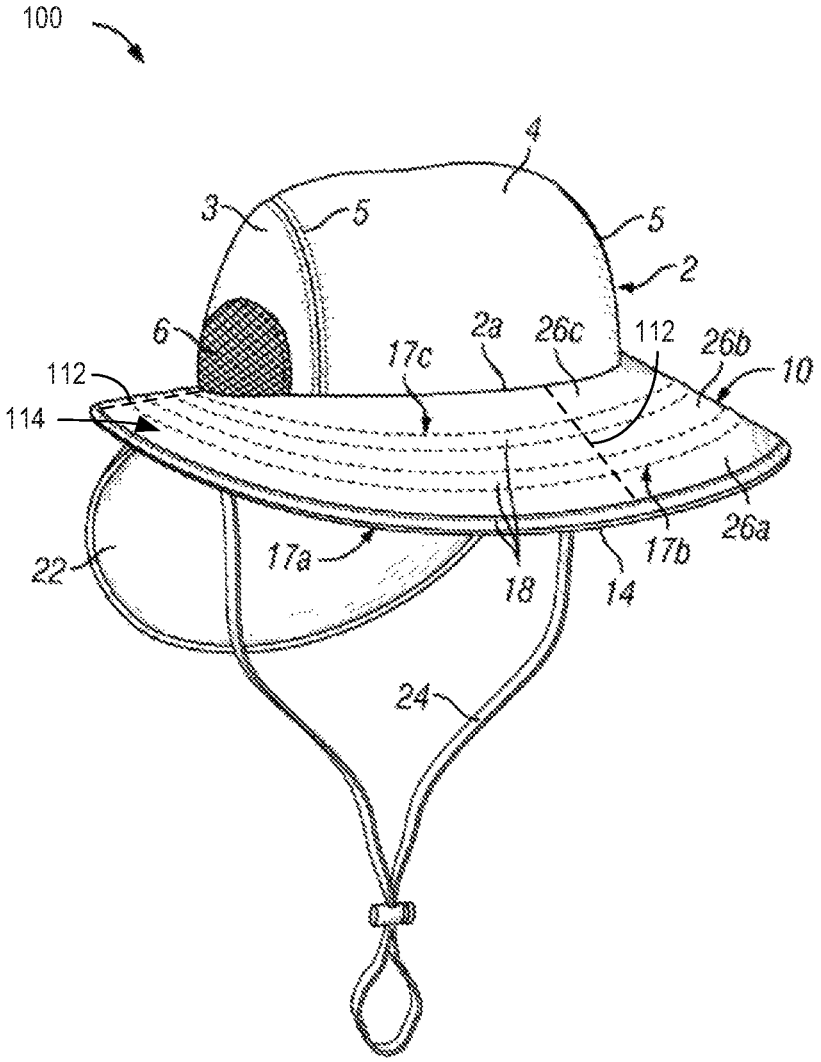
FIG. 1 shows a front isometric view of an example headwear in accordance with one or more embodiments of the present disclosure.

FIG. 1 shows a front isometric view of an example headwear 100. Headwear 100 may include a hat body 2 which in some embodiments may have a pair of spaced-apart side portions 3 and a top portion 4 which extends between the side portions 3. A seam 5 may attach each side portion 3 to the top portion 4 of the hat body 2. In other embodiments, the hat body 2 may be a one-piece construction or may have any other construction which is known by those skilled in the art. In some embodiments, vent netting 6 may be provided in the hat body 2, such as in each side portion 3, for example and without limitation, for venting purposes. An adjustment strap 7 may be provided on the hat body 2 for securing the hat body 2 on the head (not illustrated) of a wearer. In some embodiments, the hat body 2 may be a cap, visor or full brimmed hat, for example and without limitation.

In some embodiments, an adjustable chin strap 24 may extend from the hat body 2 for extension around the chin (not illustrated) of the wearer to secure the hat 100 to the head of the wearer. A flexible hat brim 10 having a rim 14 extends from the hat body 2 at a brim/hat body junction 2*a*. The hat brim 10 may be sewn and/or otherwise coupled to the hat body 2 in any suitable manner (e.g., stitching, adhering, gluing, sewing, chemical bonding, etc.). In some configurations, the hat brim 10 may be capable of bending in a segmented or stepwise manner responsive to application of an external force such as wind or water to the hat brim 10. The segmented or stepwise bending of the hat brim 10 may at least partially deflect the external force which is applied to the hat brim 10 and prevent the hat body 2 from being inadvertently dislodged from the head of the wearer. As illustrated in FIG. 1, in some embodiments the hat brim 2 may be generally crescent-shaped. In other embodiments, the hat brim 2 may have the general shape of a half-moon or may be generally circular (e.g., a full brim hat), oblong, ovular (e.g., as in a visor for a cap, such as a baseball cap, forager cap, or the like), or semicircular in configuration, for example and without limitation.

As illustrated in FIG. 1, at least one brim wire 17 (selected individual brim wires being labelled as 17*a*, 17*b*, and 17*c* in the illustrated example) is provided in the hat brim 10 between the rim 14 of the hat brim 10 and the brim/hat body junction 2*a*. The brim wire 17 divides the hat brim 10 into at least two brim sections 26. Each brim wire 17 may be a semi-flexible synthetic material such as polyester, polypropylene or nylon, for example and without limitation. In some embodiments, each brim wire 17 may have a diameter of from about 0.5 mm to about 2.5 mm. The brim wires 17 are positioned in the hat brim 10 in such a manner that the brim wires 17 hold the shape of the hat brim 10 until external forces (not illustrated) such as wind or rain, for example and without limitation, are applied against the hat brim 10.

As illustrated in FIG. 1, each brim wire 17 may have a curvature which generally corresponds to the curvature of the rim 14 of the hat brim 10. Each brim wire 17 may have a middle wire portion 18 and end wire portions (e.g., terminating ends, which may terminate into fabric and/or substrate in a region of the brim). In embodiments in which the hat brim 10 is crescent-shaped, the adjacent brim wires 17 may be disposed at their greatest spacing with respect to each other at the middle wire portions 18 of the brim wires 17. The positions of the middle wire portions 18 may generally correspond to the apex of the hat brim 10. Progressing outwardly from the middle wire portions 18, the brim wires 17 may converge and touch each other at the end wire portions. In some embodiments, the end wire portions of the respective brim wires 17 may be disposed in spaced-apart relationship with respect to each other. The brim wires 17 may be positioned in various sequences or angles in the hat brim 10 such as to accommodate the shape of the hat brim 10. In some embodiments each brim wire 17 may be circular, with the multiple brim wires 17 in the hat brim 10 arranged in concentric relationship with respect to each other in the hat brim 10. Accordingly, each brim wire 17 may completely encircle the hat body 2 in such embodiments.

Hat brim 10 may be configured to fold inward, such that the outer edges of the brim converge toward one another in an upward direction (when the hat is oriented as illustrated in FIG. 1) when folded. The folding operation may be facilitated by one or more slits 112 formed in the generally rigid or semi-rigid material of a brim substrate. Slits 112 may occupy any suitable location along the brim, including but not limited to those illustrated in FIG. 1 (e.g., along a center of a front of the brim, on either side of the brim/crown, at a rear of the brim, etc.). The brim may be formed of one or more layers of brim substrate covered (e.g., collectively and/or individually) in one or more outer layers of fabric (or other flexible material), the brim substrate being more rigid than the outer layers of fabric. For example, one or more portions of the brim (e.g., the brim substrate) may include pre-curved polymer material (e.g., 1.5 mm thick) that can be biased to retain a particular shape and have a density that enables floatation in water. In some embodiments, the bottom brim material (not visible in the view of FIG. 1) under the lowermost surface of brim substrate (e.g., facing a wearer's face) may be different than the top brim material 114 above the uppermost surface of brim substrate (e.g., facing away from the wearer).

A cape or other flap 22 may optionally extend from a rear of the headwear 100, to protect a neck of a wearer, for example. The flap 22 may extend from the crown 2 and/or hat brim 10. For example, the flap 22 may extend from an opposite end of the brim from a slit 112 formed in the brim (e.g., the slit 112 illustrated in the front/center of the brim). Such a position of the slit opposite from the flap may promote folding of the flap into a cavity formed between edges of the brim distal from the slit. For example, as the hat is folded up along the slit, the flap may be folded up by the same motion and tucked into a space formed between opposing ends of the brim that are brought together during the folding. The length of the flap extending away from a center of the hat may also correspond with an axis along which the hat is folded, thereby ensuring that the length of the flap is folded in the same motion as the brim.

Figure 2B:
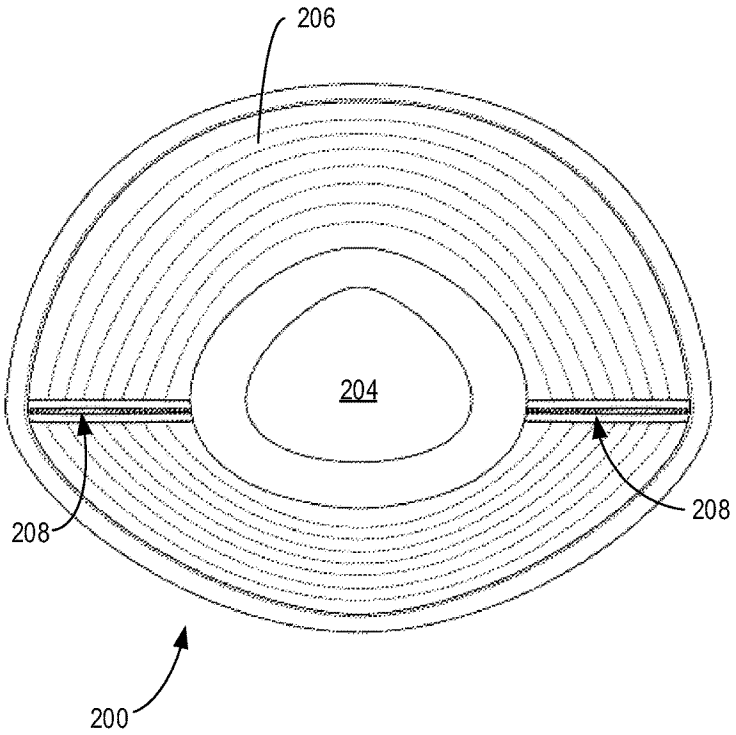
FIGS. 2A-2E show an example full-brimmed hat including a reverse split folding brim at different stages of folding in accordance with one or more embodiments of the present disclosure.
Figure 2A:
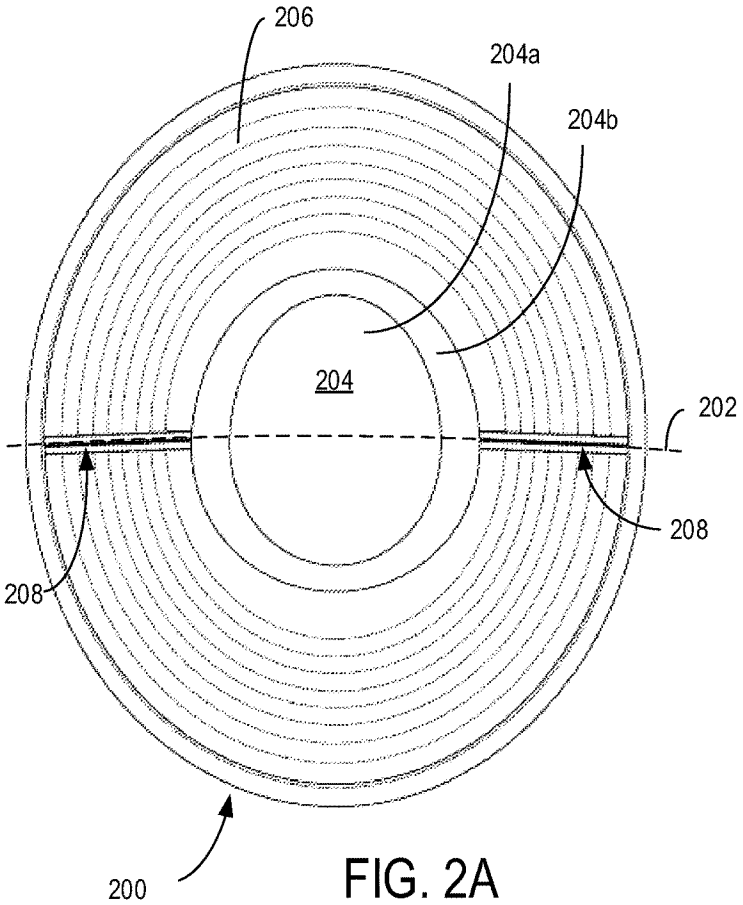

FIGS. 2A-2E show an example full-brimmed hat 200 including reverse split folding brim at different stages of folding. FIG. 2A shows the full brimmed hat 200 from a bottom view when the hat is flat (e.g., not folded). The reverse folding brim is configured to be folded along a transverse fold line 202 that is parallel and intermediate to the crown portion 204 and the brim portion 206. The crown portion 204 may include a cap 204*a* (e.g., a region of the hat covering a top of a wearer's head) and/or a sweatband/headband 204*b* (e.g., a region of the hat encircling the wearer's head and interfacing with the wearer's forehead). It is to be understood that the split brim described herein may be utilized in hats that include sweatbands/headbands but do not include caps, such as a visor. The split brim described herein may also be utilized in hats that include brims other than a full brim, such as a baseball cap. For example, a baseball cap may benefit from folding in order to stow away the cap in a compact manner within a travel bag or sports bag. The advantages of the reverse split brim described herein (e.g., allowing a crown/cap of the hat to be easily folded into the brim with a single motion and reducing "A-Frame" deformations of the brim) may provide added protection to the crown/cap of a baseball hat when stowed with other athletic equipment, for example, and help to maintain a uniform curved brim shape (e.g., as achieved by non-folding baseball caps) while worn. The fold line 202 forms a midpoint junction for parallel regions of the brim portion 206 and the crown portion 204. The fold line 202 may pass through one or more slits, such as slits 208, and the hat may be configured to fold in either direction, such that the outer edges of the brim portion 206 may engage each other and form a substantially planar configuration when folded. As illustrated, the splits may be configured to bias folding in a particular direction (e.g., folding the brim up and away from a head of a wearer, as shown in FIGS. 2B-2E).

Figure 2C:
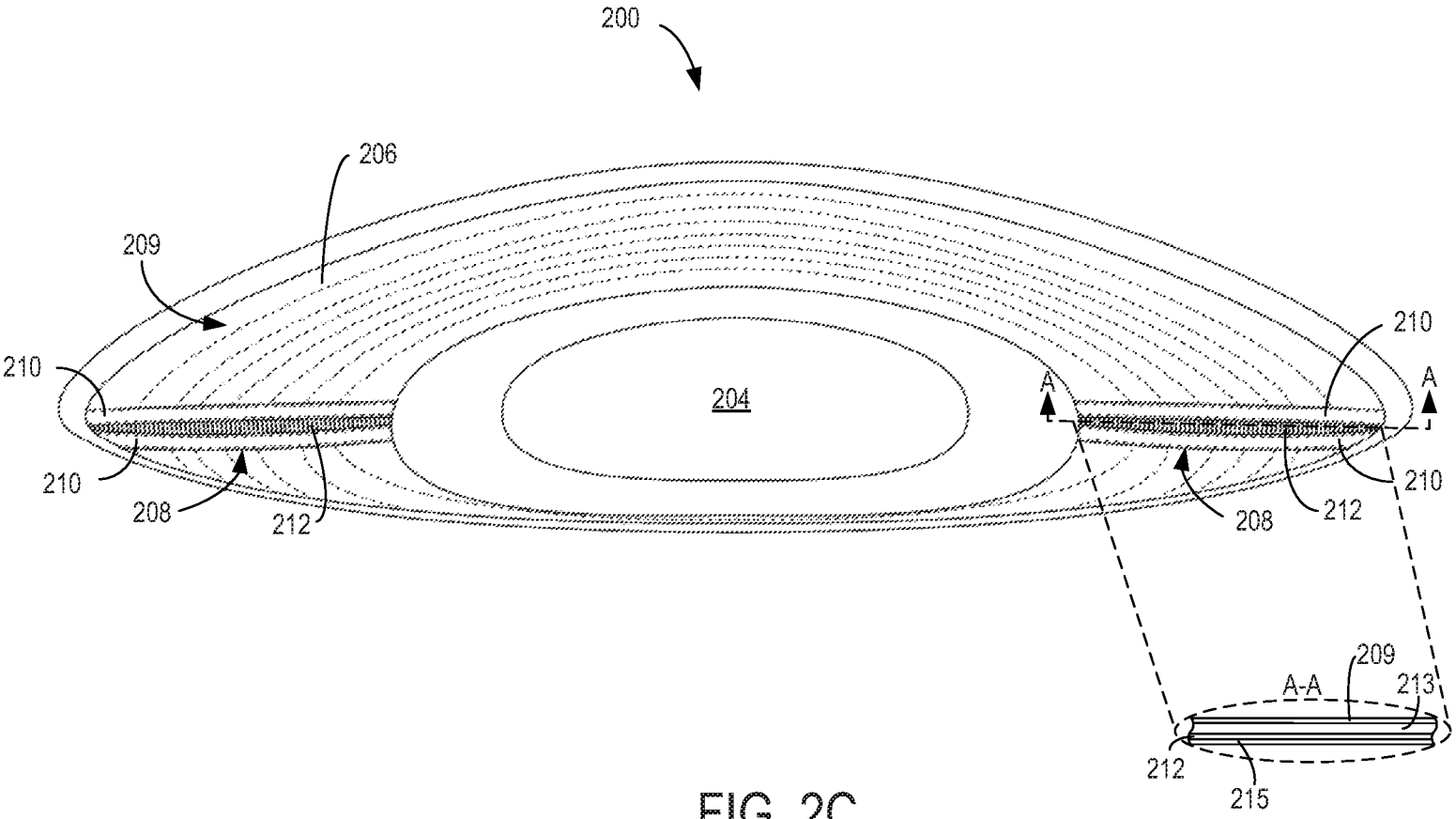
Figure 2D:
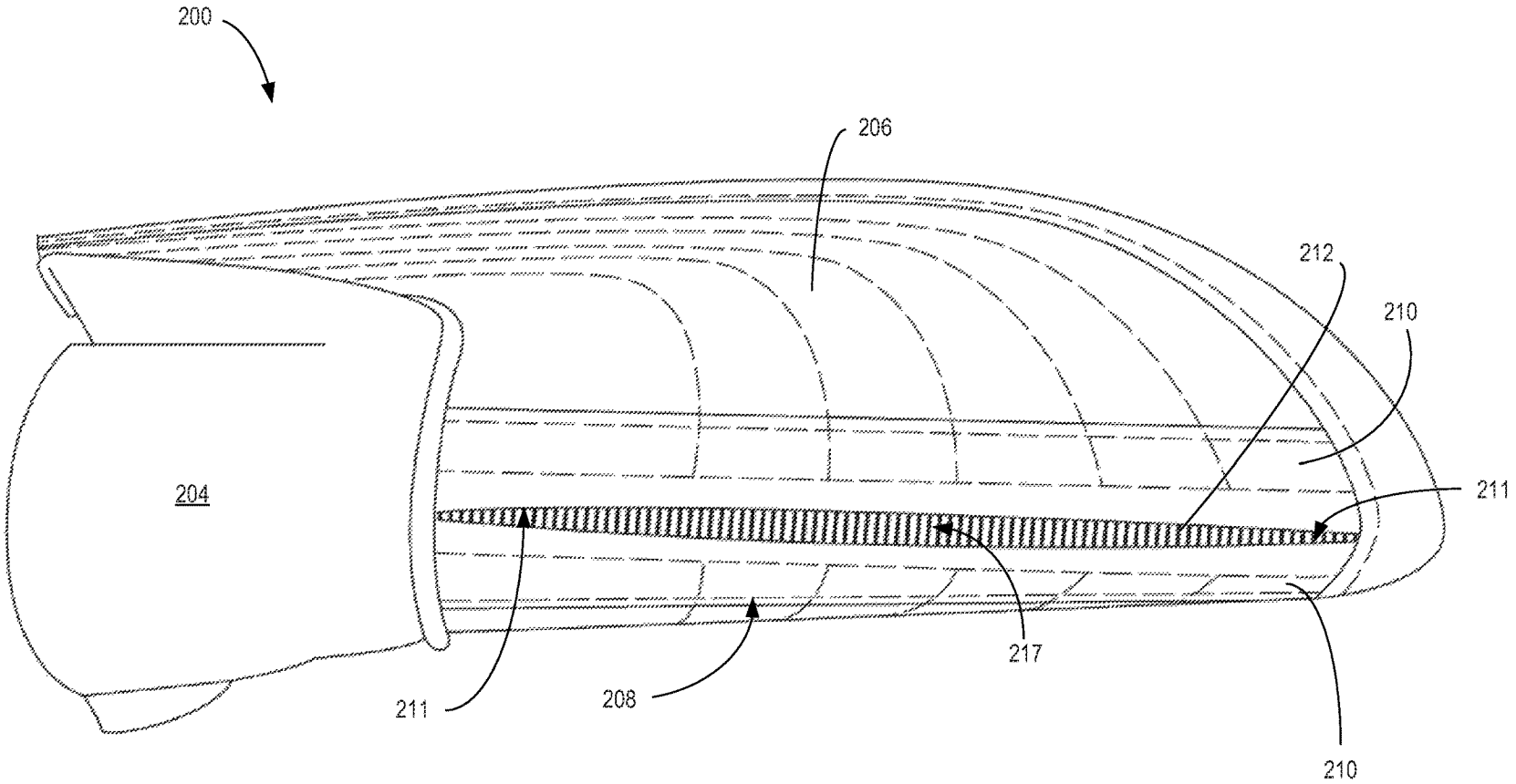
Figure 2E:
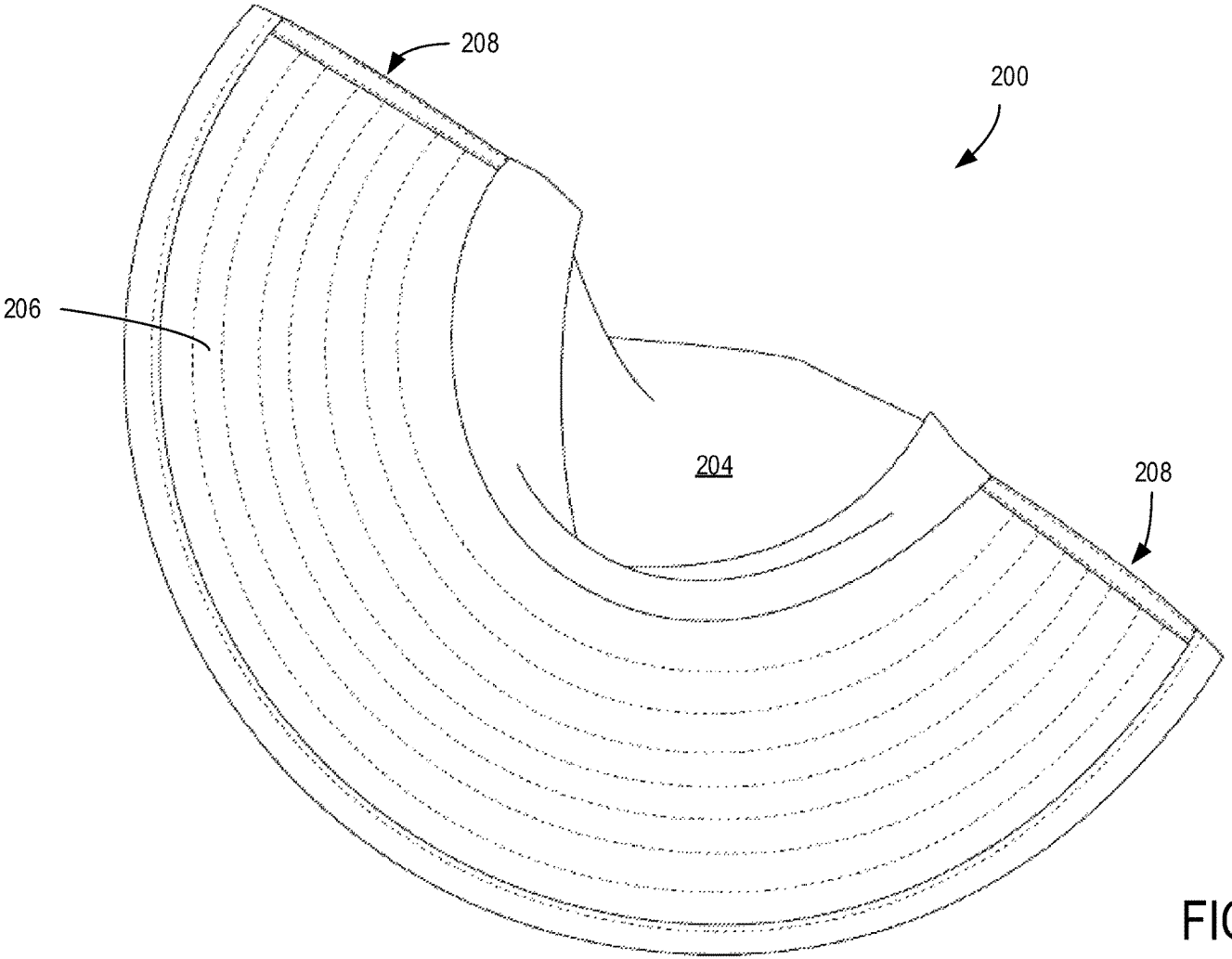

FIG. 2B shows an initial stage of folding along slits in the brim. As shown, during folding, edges of the slits 208 may separate, revealing a reinforcement fabric underneath. This separation is shown in more detail in FIGS. 2C, 2D, and 2E, which show the hat in progressively later stages of a folding process, with FIG. 2E showing the hat 200 in a fully folded configuration. It is to be understood that any suitable amount of the fold lines 202 may be provided in any suitable location along the brim. In some embodiments, the reverse-folding brim of full-brimmed hat 200 may be reinforced as described above with respect to the folding brim of head-wear 100. For example, in order to provide more robust folding operation, slit 208 may be reinforced by self-fabric exterior bias material (e.g., bias material that is the same as the outer material of the brim) and/or another reinforcing material. The slit may be reinforced at an associated seam with grosgrain or another suitable material to keep out debris and add lateral strength. For example, a piece of fabric may be folded over each edge of the slit. The additional reinforcement described above may be provided by attaching a piece of material to the underside of each seam (e.g., under the edges of each side of the slit), the material stretching between the edges of the slit. Accordingly, when folded, the piece of reinforcement material under the slit may be exposed, rather than a brim substrate or other element. The material under the slit may be formed of the same material and/or have the same pattern as the material on the upper side of the brim in some examples in order to provide a seamless transition between the brim and the reinforced slit opening. It is to be understood that coupling, as used throughout the disclosure, may refer to any suitable coupling mechanism, including but not limited to attaching, stitching, gluing, adhering, chemical bonding, sewing, etc. Particular coupling mechanisms may be performed to provide advantages relating to that coupling mechanism, and disclosure of a particular coupling mechanism to join two or more elements together may be understood to also cover the disclosure of any other suitable coupling mechanism to join those two or more elements together.

An example construction of a folding brim is performed using brim material pieces and brim substrate pieces. The brim material pieces may include material that is exposed to an environment (e.g., an outer layer of material), while the brim substrate may be sandwiched in between the brim material pieces to provide structural integrity and/or bias the brim to a selected shape. The brim substrate may not be generally exposed to the environment. The brim material pieces may be adhered on either end of a given brim substrate piece to provide a stacked construction of layers as follows: brim material (e.g., a bottom brim material piece 209), brim substrate (e.g., brim substrate 213, shown in the cross-sectional view A-A in FIG. 2C), and brim material (e.g., a top brim material piece 215, shown in the cross-sectional view A-A in FIG. 2C). As shown in FIG. 2C, for example, bias material 210 (which may be similar to the brim material and/or a more durable material than the brim material) may be coupled to a terminal end 211 of a portion of the stacked construction of brim substrate and brim material, where the terminal ends 211 form the edges of split 208. For example, the bias material may be attached to a terminal end of a bottom surface of the stacked construction (e.g., an outer/underbrim surface of a first brim material piece, which faces a wearer's face when worn) and a top surface of the brim substrate (e.g., where the outer surface of the first brim material piece is facing or in face sharing contact with a bottom surface of the brim substrate opposite the top surface of the brim substrate) and wrap around the terminal end of the portion of the stacked construction between the attachment points. The bias material may include grosgrain reinforcement along the entire length of the split to maintain the structural integrity of the split.

Multiple stacked constructions may be used to form a single brim. For example, the under brim material piece and brim substrate for two stacked constructions may be joined to one another at the terminal ends (e.g., after attaching the bias material as described above) to create a joint or hinge for the brim at the joined locations. In one example, the joining may be achieved by tacking the two pieces together. For example, the joined stacked constructions may form a circular, semicircular, or arced overall brim shape with an opening in the center where a crown may be attached. In such examples, a tack or other stitching may be provided at the location of joining of the two stacked constructions along an outer circumference (e.g., top of the joint/terminal ends, toward the outside of the brim) and an inner circumference (e.g., bottom of the joint/terminal ends, toward the inside of the brim and crown of the hat). It is to be understood that any suitable attachment points and mechanisms may be used. In still other examples, the stacked constructions may only be joined together via center webbing as described below.

A center webbing 212 may be coupled to the end regions of the brim substrate under the bias material of each stacked construction to provide further structural stability of the joint, to reduce debris buildup at the location of the joint, and/or to provide a seamless appearance when the brim is folded at the joint (e.g., exposing the center webbing across the opening 217 between the edges of the slit 208). The center webbing may extend along either (e.g., both) side of the joint on a top of the stacked brim material piece (e.g., underbrim material piece) and brim substrate 213, as shown in cross-section A-A. The center webbing may be stitched using the existing line of stitching on the bias material in some examples. For example, the center webbing may be stitched to the brim substrate, brim material, and/or bias material by stitching along the same stitch line attaching the bias material to the brim substrate/brim material. Additional material of the center webbing may extend from the stitched region along the brim substrate and may be coupled to the brim substrate at additional points. It is to be understood that the center webbing may be coupled to the brim in any suitable manner in additional or alternative examples. In some examples, the center webbing may have multiple layers of material, such as a wide base layer in face sharing contact with the brim substrate and a thin reinforcement layer on top of the base layer (e.g., closer to an upper brim material piece than the base layer). As another example, the base layer may be coupled to the brim substrate and a central layer may be coupled to the bias material. In any of the above examples, only one, some, or all layers of the center webbing may be coupled to the brim substrate and only one, some, or all layers of the center webbing may be coupled to the bias material. In some examples, the layers may be constructed of different material. In additional or alternative examples, some or all of the center webbing may include elastomeric material to promote the hinged movement of the brim. For example, the center webbing may be more elastic than the bias material.

Upper brim material pieces corresponding to the above-described under brim material pieces may be stitched together and/or otherwise coupled to one another at one or more seams. Each seam may be positioned over a respective center webbing of the partial stacked construction described above, then stitched or otherwise coupled to the center webbing (e.g., using stitchlines on the webbing as guidelines). Remaining regions of the upper brim material pieces may be basted or otherwise adhered/coupled to the brim substrate (e.g., to an opposite surface of the brim substrate from the surface facing/in face sharing contact with the under brim material pieces).

Figure 3:
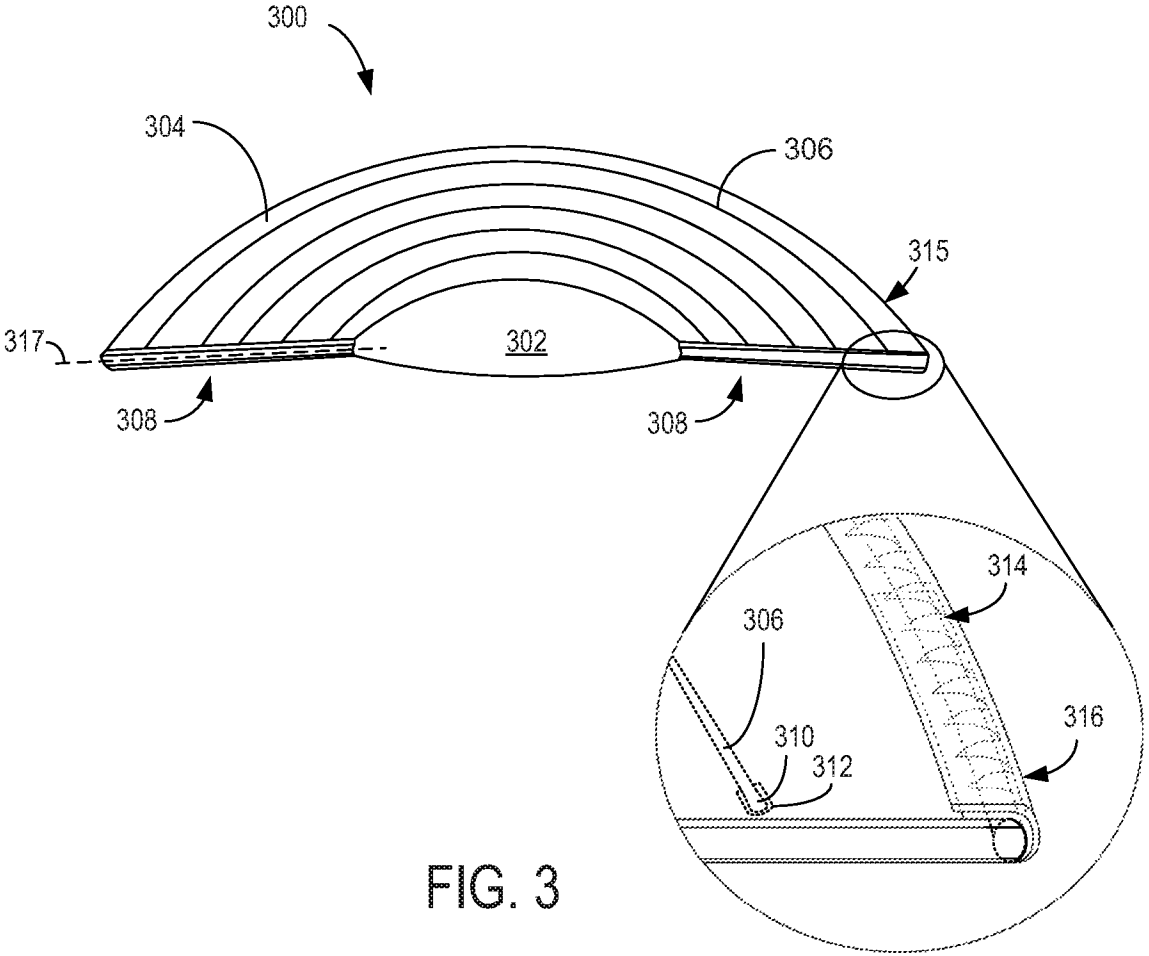
FIG. 3 shows an example hat including a reverse split folding brim with reinforcements in accordance with one or more embodiments of the present disclosure.

FIG. 3 shows an example wide brimmed hat 300 that includes a crown 302 and a brim 304 in a folded state. Hat 300 represents an additional or alternative embodiment of a reverse split brim hat in which one or more brim wires 306 are included in the brim to provide structural integrity and/or to provide the brim ratcheting functionality described above with respect to FIG. 1. The brim wires terminate into slits 308 to provide a folding operation similar to those described above with respect to FIG. 2. Outer brim wires on either longitudinal edge of the slit 308 may be secured by covering these ends of the slit (and the wires) with a heavy interfacing material, which may then be covered by material used as an outer hem of the brim. Further, in order to prevent the brim wires 306 from poking through the slits when folded, the brim wires may be protected via a coating or reinforcing material disposed on terminating ends of the brim wires. For example, FIG. 3 shows an interior view of the brim including a terminating end 310 of a brim wire 306 that is coated in a reinforcing material 312. In some examples, the heavy interfacing material and/or reinforcing material may comprise a heavy-duty fabric, such as nylon or another tightly-woven fabric. In other examples, the heavy interfacing material may include other materials, including plastic, metal, elastomeric material, silicone, and/or other suitable reinforcing material. The coating may only cover a tip of the brim wires and/or only extend partway up the brim wires, such as 2 mm from the end of the wires in one non-limiting example.

In additional or alternative embodiments, the reinforcing may be provided by material stitched to an outermost circumferential region across the slit 308. In such embodiments, terminating ends of brim wires on either side of a given slit 308 may be spaced from the slit 308 at a uniform distance. For example, each wire may be spaced from the slit 308 such that the wire terminates approximately 2 mm from the slit 308 and/or 4 mm from an associated brim wire on an opposing side of the slit 308. Each brim wire 306 may be stitched to the brim (e.g., using a zigzag machine or other stitching mechanism). One or more brim wires may also be covered with an interior reinforcing biasing material 314, such as approximately 5 cm long nylon woven fabric or other material that is stronger than the fabric used for the brim and/or the bias material of the brim. The length of the interior reinforcing material may extend across the slit and a width of the reinforcing material may extend around a circumferential edge 315 of the brim. The interior reinforcing material may be stitched in a central region (e.g., in a direction along the longitudinal/folding axis 317 of the split) to prevent the brim wires from poking through. A further exterior bias material 316 may be provided along the outermost circumference of the brim and enclose the brim wires, brim substrate, brim outer material (e.g., brim fabric), and grosgrain reinforcement (e.g., the bias reinforcement spanning the length of the split from the inner to the outer circumference of the brim). In this way, the circumferential edge of the brim may comprise multiple layers of reinforcement. An example layered construction of the circumferential edge 315 of the brim includes a bottom brim outer material piece, a center webbing, a brim substrate, a top brim outer material piece, and a bias material (e.g., grosgrain reinforcement). The layered construction may further include a brim wire extending substantially concentrically with the circumference of the brim and covered in an interior bias material (e.g., interior bias material 314). Portions of any or all of the elements of the above-described layer construction may be encased in an exterior bias material (e.g., exterior bias material 316).

The example headwear described above provide many technical advantages. A foldable brim with reinforced bias may enable the hat to be easily stored away while providing strength to the hinging point of the brim. The reverse split brim described herein may also provide the above-described folding while maintaining a smooth curved or straight shape in a flat configuration, as opposed to other hats that may suffer from an "A-Frame" peaking around a hinge or split of the brim when unfolded. Combinations of these features may be provided in a durable cap that is able to accommodate a myriad of environments and activities.

It will be understood that the configurations and/or approaches described herein are exemplary in nature, and that these specific embodiments or examples are not to be considered in a limiting sense, because numerous variations are possible. The subject matter of the present disclosure includes all novel and nonobvious combinations and subcombinations of the various structures and configurations, and other features, functions, acts, and/or properties disclosed herein, as well as any and all equivalents thereof.

The invention claimed is:

1. Headwear comprising:

a headwear body including a crown; and a hat brim extending from the crown, the hat brim having a layered structure including an upper brim material layer, an under brim material layer, and a center webbing layer sandwiched between the upper brim material layer and the under brim material layer, the under brim material layer having a slit forming a hinge on an underside of the hat brim for folding the hat brim, the slit being reinforced with bias material wrapping around the under brim material layer at each of a first edge and a second edge of the slit, the center webbing layer and the upper brim material layer extending over an opening formable between the first and second edges of the slit when the hat brim is in a folded position, the center webbing layer directly abutting the upper brim material layer at an upper surface of the center webbing layer, the center webbing layer directly abutting the bias material at an opposing under surface of the center webbing layer, and a stitched seam extending radially away from the crown and toward an outermost perimeter of the hat brim, the stitched seam joining the center webbing layer directly to the bias material.

2. The headwear of claim 1, wherein the stitched seam is joining the center webbing layer directly to the bias material such that the under surface of the center webbing layer is directly abutting an upper surface of the bias material, wherein the layered structure of the hat brim further includes a brim substrate layer positioned between the upper brim material layer and the under brim material layer, wherein the slit is further through the brim substrate layer, and wherein, for each edge of the slit, a respective portion of the bias material is:

directly coupled to a respective portion of the under brim material layer, wraps around the edge of the slit, and couples to a respective portion of the brim substrate layer.

3. The headwear of claim 2, wherein a top surface of the upper brim material layer and a lower surface of the under brim material layer define outermost surfaces of the hat brim, and wherein the upper surface of the center webbing layer directly abuts a lower surface of the upper brim material layer opposite the top surface of the upper brim material layer.

4. The headwear of claim 3, wherein the lower surface of the under brim material layer is adapted to face a face of a wearer and the top surface of the upper brim material layer is adapted to face away from the face of the wearer, and wherein the bias material is directly coupled to a top surface of the brim substrate layer between the top surface of the brim substrate layer and the lower surface of the upper brim material layer.

5. The headwear of claim 4, wherein the center webbing layer is further stitched to the brim substrate layer via a line of stitching extending around the outermost perimeter of the hat brim, and wherein the center webbing layer is stitched to the upper brim material layer along the line of stitching attaching the center webbing layer to the brim substrate layer.

6. The headwear of claim 2, wherein the brim substrate layer comprises two pieces that are tacked together at a top terminal end and a bottom terminal end of the brim substrate layer, and wherein the slit includes a brim substrate slit that is formed between the two pieces.

7. The headwear of claim 2, wherein the bias material is further stitched to the brim substrate layer via a line of stitching extending around the outermost perimeter of the hat brim, and wherein the center webbing layer is stitched to the brim substrate layer along the line of stitching attaching the bias material to the brim substrate layer.

8. The headwear of claim 2, wherein the hat brim further comprises one or more brim wires.

9. The headwear of claim 8, wherein the one or more brim wires include terminating ends that terminate into a respective one of the first edge and the second edge of the slit, the terminating ends of the brim wires being coated with reinforcing material.

10. The headwear of claim 8, wherein a circumferential edge of the hat brim is reinforced with reinforcing material covering terminating ends of the brim wires on each side of the slit.

11. The headwear of claim 10, wherein the reinforcing material extends across the opening formable between the first and second edges of the slit and along the circumferential edge of the hat brim, the reinforcing material enclosing at least a portion of each of the brim substrate layer, the under brim material layer, the upper brim material layer, the center webbing layer, and the bias material.

12. The headwear of claim 1, wherein the center webbing layer includes elastomeric material, wherein the upper brim material layer and the under brim material layer include different material than the center webbing layer, and wherein the slit formed in the under brim material layer is a first slit on a first side of the hat brim, the hat brim further including a second slit passing through the under brim material layer on a second, opposing side of the hat brim.

13. Headwear comprising:

a headwear body including a crown; and a hat brim extending from the crown, the hat brim including:

an upper brim material piece, an under brim material piece, one or more slits in the under brim material piece, each of the one or more slits forming a respective hinge on an underside of the hat brim for folding the hat brim, a center webbing sandwiched between the upper brim material piece and the under brim material piece and directly abutting the upper brim material piece, the center webbing and the upper brim material piece extending across an opening formed by at least one of the slits in the under brim material piece, and one or more brim wires each extending around the hat brim and terminating into an associated edge of the one or more slits, each slit being reinforced with: bias material along each of a respective first edge and a respective second edge of each of the one or more slits, the bias material wrapping around each edge of the one or more slits, and a stitched seam extending radially away from the crown and toward an outermost perimeter of the hat brim, the stitched seam joining the center webbing directly to the bias material such that at least part of a first surface of the center webbing is directly abutting at least part of a second surface of the bias material.

14. The headwear of claim 13, wherein the hat brim further includes a brim substrate, the brim substrate being sandwiched between the upper brim material piece and the under brim material piece, and wherein a lower surface of the under brim material piece and a top surface of the upper brim material piece define outermost surfaces of the hat brim.

15. The headwear of claim 14, wherein the lower surface of the under brim material piece is adapted to face a face of a wearer and the top surface of the upper brim material piece is adapted to face away from the face of the wearer, wherein the bias material is coupled to a top surface of the brim substrate between the top surface of the brim substrate and a lower surface of the upper brim material piece, the lower surface of the upper brim material piece being opposite the top surface of the upper brim material piece.

16. The headwear of claim 13, wherein the center webbing includes elastomeric material, the center webbing being more elastic than the bias material.

17. Headwear comprising:

a headwear body including a crown; and a foldable hat brim extending from the crown, the foldable hat brim having a layered structure including:

an upper surface of the foldable hat brim, a lower surface of the foldable hat brim, a brim substrate disposed between the upper and lower surfaces of the foldable hat brim and directly abutting the lower surface of the foldable hat brim, a slit formed in the brim substrate and in the lower surface of the foldable hat brim, bias material disposed along a periphery of the slit, and a center webbing disposed above the slit and directly abutting the upper surface of the foldable hat brim over an opening formed between edges of the slit, the center webbing being directly coupled to one or more of the bias material and the brim substrate at a location that is sandwiched between the upper and lower surfaces of the foldable hat brim, the bias material directly coupled to the brim substrate at a location between the brim substrate and the upper surface of the foldable hat brim and wrapping around a layered construction formed by the brim substrate and the lower surface of the foldable hat brim, and interior reinforcing material extending across the slit, a length of the interior reinforcing material extending across the slit bridging opposing edges of the slit, and a width of the interior reinforcing material extending around a circumferential edge of the foldable hat brim bridging the upper and lower surfaces of the foldable hat brim, a first stitched seam extending radially away from the crown and toward an outermost perimeter of the hat brim, the first stitched seam joining the center webbing directly to the bias material, a second stitched seam joining the center webbing to the brim substrate, and a third stitched seam joining the center webbing to the upper surface of the foldable hat brim along the second stitched seam.

18. The headwear of claim 17, the foldable hat brim further comprising one or more brim wires disposed between the upper and lower surfaces of the foldable hat brim and having terminating ends terminating in the slit, and additional reinforcing material covering the terminating ends of the one or more brim wires.

* * * * *